United States Patent [19]

Ishimoto

[11] Patent Number: 5,071,324

[45] Date of Patent: Dec. 10, 1991

[54] FUEL INJECTION PUMP

[75] Inventor: Masayori Ishimoto, Higashimatsuyama, Japan

[73] Assignee: Zexel Corporation, Tokyo, Japan

[21] Appl. No.: 606,468

[22] Filed: Oct. 31, 1990

[30] Foreign Application Priority Data

Nov. 29, 1989 [JP] Japan ..... 1-307617

[51] Int. Cl.[5] ..... F04B 7/04

[52] U.S. Cl. ..... 417/490; 417/499; 123/495; 123/509

[58] Field of Search ..... 417/511, 490, 494, 499; 123/509, 495, 511; 92/169.1

[56] References Cited

U.S. PATENT DOCUMENTS

| | | | |
|---|---|---|---|
| 3,885,895 | 5/1975 | Staudt et al. | 417/490 |
| 4,286,931 | 9/1981 | Häfele et al. | 417/490 |
| 4,430,977 | 2/1984 | Shimada | 123/509 |
| 4,494,513 | 1/1985 | Torizuka | 417/499 |

FOREIGN PATENT DOCUMENTS 58-204963 11/1983 Japan .

*Primary Examiner*—Richard A. Bertsch
*Assistant Examiner*—Michael I. Kocharov

[57] ABSTRACT

A fuel injection pump includes a barrel mounted in a barrel mounting hole in a pump body. The barrel has a cylinder hole and a valve mounting hole which are coaxial with the barrel. The inner peripheral surface of the cylinder hole and the inner peripheral surface of said valve mounting hole are interconnected by an annular shoulder surface. A plunger is slidably received in the cylinder hole, and a delivery valve is mounted in the valve mounting hole. The delivery valve includes a valve seat, and a valve holder which is tightly threaded into the valve mounting hole, so that the valve seat is firmly held between the valve holder and the shoulder surface of the barrel. One end face of said valve seat is held in direct contact with the barrel shoulder surface under a high pressure. In order to achieve a good contact between the two to provide a good seal therebetween, the hardness of the barrel shoulder surface is not more than HV400; however, the inner peripheral surface of the cylinder hole with which the plunger is in sliding contact has a hardness of not less than HV750.

6 Claims, 2 Drawing Sheets

FUEL INJECTION PUMP

BACKGROUND OF THE INVENTION

This invention relates to a fuel injection pump suited for injecting high-pressure fuel.

In fuel injection pumps disclosed in Japanese Laid-Open (Kokai) Patent Application No. 204963/83 and U.S. Pat. No. 3,885,895, a pump body is made of aluminum in order to achieve a lightweight design of the pump, and a barrel harder than the pump body is used so as to enable the injection of high-pressure fuel. The barrel is mounted in a barrel mounting hole formed in the pump body. A flange is formed on one end of the barrel, and is fixedly secured to the pump body.

The barrel has a cylinder hole and a valve mounting hole which are continuous with each other and are coaxial with the barrel. The inner peripheral surfaces of the cylinder hole and the valve mounting hole are interconnected by an annular flat shoulder surface disposed perpendicular to the axis of the barrel.

A plunger is slidably received in the cylinder hole. A pump chamber is formed by the inner peripheral surface of the cylinder hole and one end face of the plunger.

A delivery valve is mounted in the valve mounting hole. The delivery valve comprises an annular valve seat having a valve port, a valve element for opening and closing the valve port, a spring urging the valve element in a valve closing direction, and a valve holder. The valve holder is threaded into the valve mounting hole. The valve seat is interposed or held between the shoulder surface of the barrel and the valve holder.

Fuel in the pump chamber is pressurized or compressed by the plunger, and is fed under pressure to a fuel injection nozzle, mounted on an engine, via the delivery valve.

Generally, a requirement for the barrel is that the inner peripheral surface of the cylinder hole will not be subjected to premature wear due to a high-speed sliding movement of the plunger. To meet this requirement, in the above Japanese Laid-Open Patent Application No. 204963/83, the hardness of the inner peripheral surface of the cylinder hole is not less than HRc60 (not less than HV697), and in U.S. Pat. No. 3,885,895, this hardness is HRc61(HV720).

In the above fuel injection pumps, it is necessary to prevent the high-pressure fuel in the pump chamber from leaking to the exterior through the area of contact between the shoulder surface of the barrel and the valve seat. To achieve a good seal between the barrel shoulder surface and the valve seat, two requirements must be met. A first requirement is that the valve holder should be threaded into the valve mounting hole with a high force so as to hold the valve seat in firm contact with the barrel shoulder surface. Since this threading force does not act on the pump body of a low strength, the first requirement can be met easily. A second requirement is that the valve seat and the barrel shoulder surface should be held in intimate face-to-face contact with each other over the entire areas thereof. This requirement can not easily be met. The reason is that since the shoulder surface is formed in the inside of the barrel, it is difficult to obtain highly-precise flatness of the shoulder surface, as well as highly-precise perpendicularness of the shoulder surface relative to the axis of the barrel, by grinding.

In the fuel injection pump of U.S. Pat. No. 3,885,895, a gasket of a copper alloy is interposed between the shoulder surface of the barrel and the valve seat of the delivery valve. The copper alloy gasket is relatively soft, and therefore even if the flatness and perpendicularness of the shoulder surface are somewhat low in precision, the gasket is elastically deformed, involving a local plastic deformation, so that the opposite sides of the gasket are brought into contact with the barrel shoulder surface and the valve seat over generally the entire areas thereof, thereby achieving good sealing properties. However, this construction is not suitable when it is required to pressurize the fuel to a higher degree. The reason for this will now be described. In order to seal the fuel of greater pressure, it is necessary to hold the gasket in contact with the barrel shoulder surface and the valve seat under greater pressure. In this case, however, the gasket is plastically deformed over the entire area thereof, and therefore fails to increase the contact pressure. In the worst case, the gasket is damaged or ruptured.

In the above Japanese Laid-Open Patent Application No. 204963/83, no gasket is used, and the shoulder surface of the barrel is in direct contact with the valve seat. With particular reference to FIG. 2 of this prior Japanese application, the hardness of the barrel shoulder surface is HRc45 to HRc60 (Vickers hardness: HV446 to HV697), and even if the valve seat is strongly urged against the barrel shoulder surface, no local plastic deformation occurs. Therefore, an error in flatness of the shoulder surface as well as an error in perpendicularness of the shoulder surface relative to the axis of the barrel, can not be absorbed, thus failing to achieve good sealing properties.

In the above U.S. patent and the above Japanese application (FIG. 2), besides the hardness of the inner peripheral surface of the cylinder hole in the barrel, the hardness of the threaded portion of the valve mounting hole is improved. The threaded portion is soft to have such toughness as to withstand a reaction force applied from the valve seat. More specifically, the barrel is heat-treated in such a manner as to create a hardness gradient in the direction of the axis thereof, so that that region of the barrel including the cylinder hole is the highest in hardness whereas that region of the barrel including the threaded portion is the lowest in hardness. The hardness of the threaded portion of the above U.S. patent is below HRc36 (below HV354), and the hardness of the threaded portion of the above Japanese application is HRc35 (HV345). However, the hardness of the barrel shoulder surfaces of these prior art is too high, and is not suitable for enhancing the sealing properties. Moreover, the barrel shoulder surface is continuous with the inner peripheral surface of the cylinder hole, and therefore the intended hardness of the barrel shoulder surface which is an important feature of the present invention can not be obtained by the heat treatment causing a gentle hardness gradient in the direction of the axis of the barrel as in the above prior art.

SUMMARY OF THE INVENTION

It is therefore an object of this invention to provide a fuel injection pump in which wear of an inner peripheral surface of a cylinder hole in a barrel is prevented, and the hardness of a barrel shoulder surface is improved so as to enhance a seal between a valve seat and the barrel shoulder surface.

According to the present invention, there is provided a fuel injection pump comprising:

(a) a pump body having a barrel mounting hole;

(b) a barrel mounted in the barrel mounting hole, the barrel having a cylinder hole and a valve mounting hole which are continuous with each other and are coaxial with the barrel, the valve mounting hole being greater in diameter than the cylinder hole, the barrel having an annular shoulder surface interconnecting inner peripheral surfaces of the valve mounting hole and the cylinder hole, and a threaded portion being formed on the inner peripheral surface of the valve mounting hole;

(c) a plunger received in the cylinder hole for sliding movement therealong, a pump chamber being formed by one end face of the plunger and the inner peripheral surface of the cylinder hole; and (d) a delivery valve mounted in the valve mounting hole in the barrel, the delivery valve including an annular valve seat having a valve port, a valve element movable for opening and closing the valve port, a spring urging the valve element toward the valve port so as to close the valve port, and a valve holder, the valve holder being tightly threaded into the valve mounting hole, so that the valve seat is urged by the valve holder in such a manner that one side of the valve seat is held in direct contact with the shoulder surface of the barrel under a high pressure;

wherein the shoulder surface of the barrel has Vickers hardness of not more than HV400, the inner peripheral surface of the cylinder hole having Vickers hardness of not less than HV750.

DESCRIPTION OF THE PREFERRED EMBODIMENT OF THE INVENTION

Figure 1:
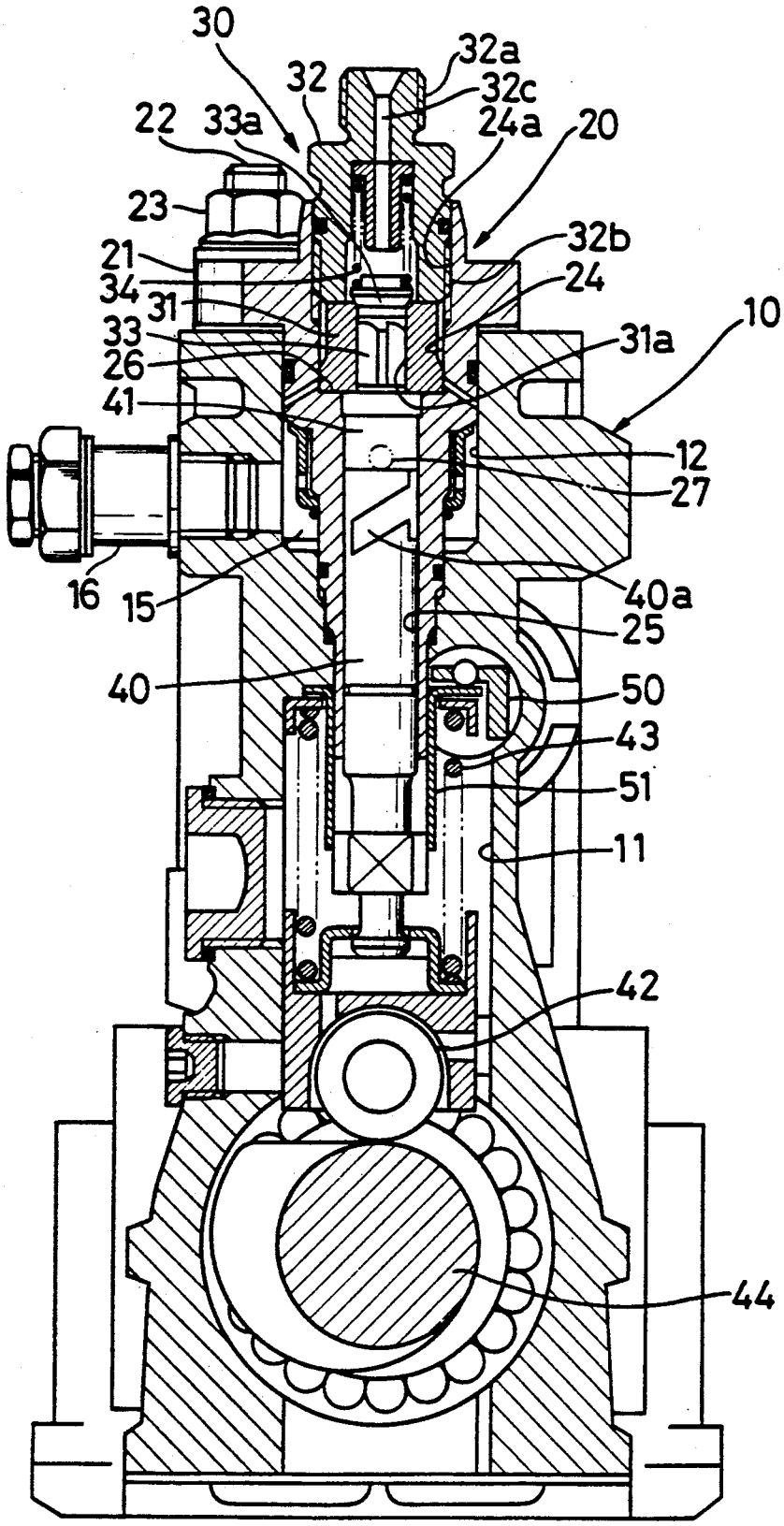
FIG. 1 is a vertical cross-sectional view of a fuel injection pump provided in accordance with the present invention.

One preferred embodiment of the invention will now be described with reference to the drawings. FIG. 1 shows a in-line fuel injection pump for a diesel engine, and this fuel injection pump is of a conventional construction. A pump body 10 is made of aluminum or the like, and extends in a direction perpendicular to the sheet of FIG. 1. The pump body 10 has a plurality of through holes 11 (only one of which is shown in the drawings), and are arranged along the length of the pump body 10. Each of the through holes 11 extends through the pump body 10 from an upper end surface of the pump body to a lower end surface of the pump body. An upper portion of the through hole 11 serves as a stepped barrel mounting hole 12.

A barrel 20 is inserted in the barrel mounting hole 12 in the pump body 10. A non-circular flange 21 is formed on the upper end of the barrel 20, and the flange 21 rests on the upper end surface of the pump body 10. The flange 21 is fixedly secured to the pump body 10 by a stud 22 and a nut 23, the stud 22 extending through the flange 21 and threaded into a threaded hole formed in the upper end surface of the pump body 10.

Figure 2:
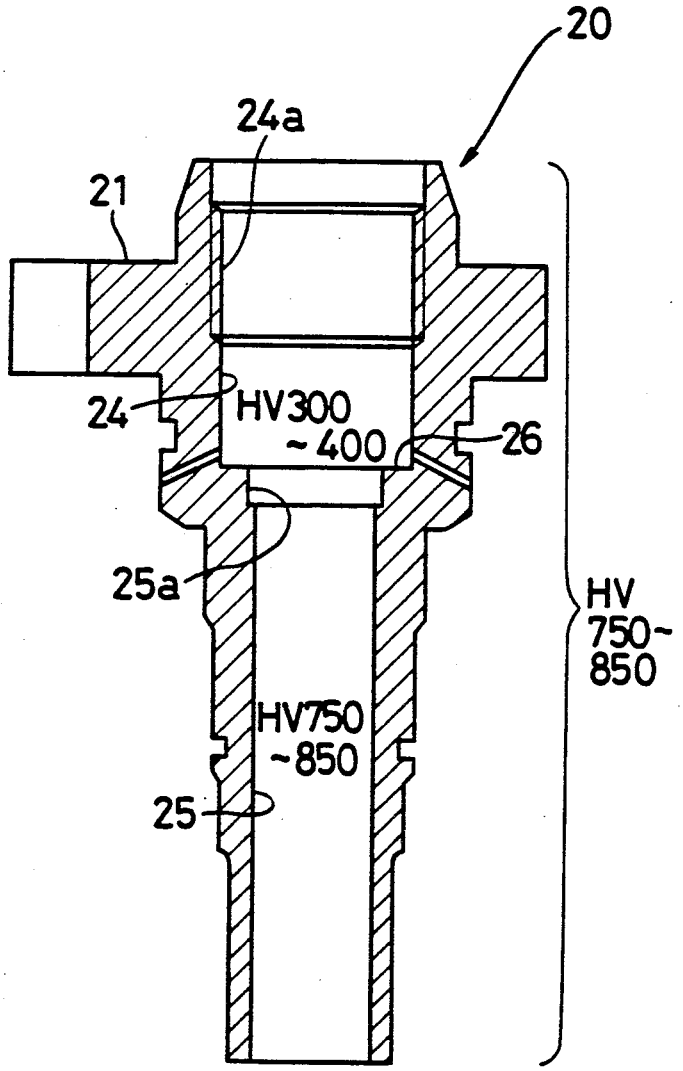
FIG. 2 is an enlarged, vertical cross-sectional view of a barrel of the fuel injection pump, illustrative of the surface hardness of the barrel.

As best shown in FIG. 2, the barrel 20 has a valve mounting hole 24 at its upper portion, and a cylinder hole 25 at its lower portion. The valve mounting hole 24 and the cylinder hole 25 are coaxial with the barrel 20, and are continuous with each other. The valve mounting hole 24 is greater in diameter than the cylinder hole 25, and the inner peripheral surface of the valve mounting hole 24 and the inner peripheral surface of the cylinder hole 25 are interconnected by an annular shoulder surface 26. The width of the shoulder surface 26 is equal to the difference between the radius of the valve mounting hole 24 and the radius of the cylinder hole 25. The shoulder surface 26 is flat and is disposed perpendicular to the axis of the barrel 20. A threaded portion 24*a* is formed on the upper portion of the inner peripheral surface of the valve mounting hole 24. The cylinder hole 25 is slightly greater in diameter at its upper end portion 25*a* than at the other portion thereof. An intake and exhaust port 27 (only shown in FIG. 1) is formed through the peripheral wall of the barrel 20, and is disposed below the enlarged upper end portion 25*a* of the cylinder hole 25.

As shown in FIG. 1, a delivery valve 30 is mounted in the valve mounting hole 24. More specifically, the delivery valve 30 comprises a valve seat 31, a valve holder 32, a valve element 33, and a valve spring 34.

The valve seat 31 is annular, and has a valve port 31*a* extending along the axis of the valve seat 31. The upper and lower end faces of the valve seat 31 are flat, and are disposed perpendicular to the axis of the valve seat 31. The valve seat 31 is received in the lower portion of the valve mounting hole 24, and the lower end face of the valve seat 31 is disposed in direct contact with the shoulder surface 26 of the barrel 20.

The valve holder 32 has threaded portions 32*a* and 32*b* formed respectively on upper and lower portions of the outer periphery of the valve holder 32. The valve holder 32 also has a stepped through hole 32*c* extending axially therethrough. The lower threaded portion 32*b* of the valve holder 32 is threaded into the threaded portion 24*a* of the valve mounting hole 24. By tightly threading the valve holder 32 into the valve mounting hole 24, the valve seat 31 is firmly held between the lower end of the valve holder 32 and the shoulder surface 26 of the barrel 20. The upper end of the valve holder 32 is connected to a fuel injection nozzle (not shown) via a pipe.

The valve element 33 is slidably received in the valve port 31*a* of the valve seat 31, and a head 33*a* of the valve element 33 opens and closes the valve port 31*a*. The valve spring 34 is received in the lower portion of the through hole 32*c* of the valve holder 32, and urges the valve element 33 downward, that is, in a valve closing direction.

A plunger 40 is slidably received in the cylinder hole 25 in the barrel 20. A pump chamber 41 is formed by the upper end face of the plunger 40 and the inner peripheral surface of the cylinder hole 25. The pump chamber 40 is communicated with a fuel chamber 15 via the intake and exhaust port 27 in the barrel 20. The fuel chamber 15 is formed between the outer peripheral surface of the barrel 20 and the inner peripheral surface of the barrel mounting hole 12 in the pump body 10. The fuel chamber 15 is connected to a fuel supply pump (not shown) via a fitting 16 and a pipe.

A cam follower 42 is mounted on the lower end of the plunger 40. The cam follower 42 is urged downward by a spring 43, received in the through hole 11 in the pump body 10, and is held in contact with a cam shaft 44 extending through the pump body 10 in a direction perpendicular to the sheet of FIG. 1. The plunger 40 is moved upward and downward in response to the rotation of the cam shaft 44. When the plunger 40 moves upward to close the intake and exhaust port 27, the fuel in the pump chamber 41 is pressurized or compressed. The thus pressurized fuel opens the delivery valve 30, and is fed under pressure to the fuel injection nozzle, and then is injected from the fuel injection nozzle into a combustion chamber of the engine. When upon further upward movement of the plunger 40, its lead 40*a* (i.e., obliquely-extending notch formed in the upper end portion of the outer peripheral surface of the plunger 40) is brought into communication with the intake and exhaust port 27, the pump chamber 41 is communicated with the low-pressure fuel chamber 15, so that the delivery valve 30 is closed, thus finishing the fuel injecting operation. In contrast, when the plunger 40 is moved downward, the fuel in the fuel chamber 15 is fed into the pump chamber 41 via the intake and exhaust port 27.

A control rack 50 extends through the pump body 10 for movement in a direction perpendicular to the sheet of FIG. 1. When the control rack 50 is moved, the plunger 40 is angularly moved about its axis through a control sleeve 51. As a result, the position of the lead 40*a* relative to the intake and exhaust port 27 is changed, thereby adjusting the amount of injection of the fuel.

Next, the barrel 20 constituting an important feature of the present invention will now be described in detail. A unique hardness distribution is imparted to the barrel 20 by the following process. A base material for the barrel 20 is first prepared. This base material is prepared by machining a steel material (e.g. SCM415) into the shape shown in FIG. 2 and then by heat-treating the thus shaped steel material to bring it into a Vickers hardness of HV300 to HV400. Then, a masking such as copper plating is applied to the inner peripheral surface of the valve mounting hole 24 and the shoulder surface 26, and then the base material is carburized. By doing so, the inner peripheral surface of the cylinder hole 25 in the barrel 20, as well as the entire outer surface of the barrel 20, is caused to have a hardness of not less than HV750, and preferably of HV750 to HV850. The hardness of the inner peripheral surface of the valve mounting hole 24 as well as the hardness of the shoulder surface 26 is kept equal to the hardness of the base material, that is, HV300 to HV400. The hardness of the peripheral wall of the barrel 20 is about HV510 at those regions thereof spaced 0.5 mm from the inner peripheral surface of the cylinder hole 25 and the outer surface of the barrel 20. The hardness of the more inner portions of this peripheral wall not influenced by the carburizing treatment remains HV300 to HV400. The above masking is removed after the carburizing treatment.

Incidentally, the hardness of the valve seat 31 is about HV700, and the hardness of the valve holder 32 is HV300 to HV400.

As described above, the hardness of the shoulder surface 26 is as low as HV300 to HV400, and therefore when the valve seat 31 is brought into direct contact with the shoulder surface 26 with a large force, an error in flatness of the shoulder surface 26, as well as an error in perpendicularness of the shoulder surface 26 relative to the axis of the barrel 20, is suitably absorbed. Namely, the shoulder surface 26 is subjected to local plastic deformation, so that the shoulder surface 26 can be satisfactorily held in face-to-face contact with the lower end face of the valve seat 31 over the entire area thereof. And besides, in this face-to-face contact condition, the shoulder surface 26 is subjected to elastic deformation, and therefore in response to the force of threading of the valve holder 32 into the valve mounting hole 24, the valve seat 31 and the shoulder surface 26 can be held in contact with each other under high pressure. As a result, even when the fuel pressure in the pump chamber 41 is high, a good seal is provided between the valve seat 31 and the shoulder surface 26.

The reason why the hardness of the base material for the barrel 20 is HV300 to HV400 will now be described. If the hardness of the base material for the barrel 20 is more than HV400, it is difficult to cause a local plastic deformation of the shoulder surface 26 having the same hardness as that of the base material. This adversely affects the fact-to-fact contact between the shoulder surface 26 and the valve seat 31. In contrast, if the hardness of the base material for the barrel 20 is less than HV300, the strength of the barrel 20 itself is unduly lowered.

On the other hand, the hardness of the inner peripheral surface of the cylinder hole 25 is HV750 to HV850, and the hardness at the depth of 0.5 mm is about HV510. Therefore, the inner peripheral surface of the cylinder hole 25 is prevented from undergoing premature wear by the sliding contact of the plunger 40. Further, since the hardness of the threaded portion 24*a* is HV300 to HV400, the threaded portion 24*a* has toughness enough to withstand a strong threading force applied by the valve holder 32.

Further, in this embodiment, the hardness of the outer surface of the barrel 20 is also as high as HV750 to HV850, and therefore the barrel 20 has an increased strength, and those portions of the barrel 20 disposed in contact with the control sleeve 50 are prevented from undergoing premature wear.

The present invention is not to be restricted to the above embodiment, and suitable modifications can be made without departing from the spirits of this invention.

For example, the inner peripheral surface of the enlarged upper end portion 25*a* of the cylinder hole 25 which is not in sliding contact with the plunger may not be subjected to the surface hardening treatment. With respect to the surface hardening treatment of the inner peripheral surface of the cylinder hole and the outer surface of the barrel, the carburizing treatment may be replaced by a nitriding treatment.

The shoulder surface of the barrel as well as the lower end face of the valve seat may be a tapered surface having an axis lying on the axis of the barrel. Also, the lower end face of the valve seat may be a convexly curved surface not complementary to the shoulder surface.

What is claimed is:

1. In a fuel injection pump comprising:

(a) a pump body having a barrel mounting hole;

(b) a barrel mounted in said barrel mounting hole, said barrel having a cylinder hole and a valve mounting hole which are continuous with each other and are coaxial with said barrel, said valve mounting hole being greater in diameter than said cylinder hole, said barrel having an annular shoulder surface interconnecting inner peripheral surfaces of said valve mounting hole and said cylinder hole, and a threaded portion being formed on the inner peripheral surface of said valve mounting hole;

(c) a plunger received in said cylinder hole for sliding movement therealong, a pump chamber being formed by one end face of said plunger and the inner peripheral surface of said cylinder hole; and (d) a delivery valve mounted in said valve mounting hole in said barrel, said delivery valve including an annular valve seat having a valve port, a valve element movable for opening and closing said valve port, a spring urging said valve element toward said valve port so as to close said valve port, and a valve holder, said valve holder being tightly threaded into said valve mounting hole, so that said valve seat is urged by said valve holder in such a manner that one side of said valve seat is held in direct contact with said shoulder surface of said barrel under a high pressure;

the improvement wherein said shoulder surface of said barrel has Vickers hardness of not more than HV400, the inner peripheral surface of said cylinder hole having Vickers hardness of not less than HV750.

2. A fuel injection pump according to claim 1, in which the hardness of said shoulder surface of said barrel is in the range of between HV300 and HV400, the hardness of the inner peripheral surface of said cylinder hole being in the range of between HV750 and HV850.

3. A fuel injection pump according to claim 2, in which the hardness of the interior of a peripheral wall of said barrel is in the range of between HV300 and HV400, the hardness of said shoulder surface being substantially equal to the hardness of the interior of said peripheral wall of said barrel.

4. A fuel injection pump according to claim 3, in which the hardness of the inner peripheral surface of said valve mounting hole is substantially equal to the hardness of said shoulder surface.

5. A fuel injection pump according to claim 4, in which the hardness of the entire outer surface of said barrel is substantially equal to the hardness of the inner peripheral surface of said cylinder hole.

6. A method of producing a barrel of a fuel injection pump, comprising the steps of:

(a) preparing a barrel base material having a hardness of HV300 to HV400; and (b) subsequently applying a masking to an inner peripheral surface of a valve mounting hole and a shoulder surface in said barrel, and subsequently subjecting said barrel base material to a surface hardening treatment, so that the inner peripheral surface of a cylinder hole in said barrel as well as the outer surface of said barrel is caused to have a hardness of HV750 to HV850 while maintaining the hardness of the inner peripheral surface of said valve mounting hole and the hardness of said shoulder surface at HV300 to HV400.

* * * * *